United States Patent [19]

Hunter

[11] 4,129,198

[45] Dec. 12, 1978

[54] POLE SEAT AND LADDER

[76] Inventor: Alex E. Hunter, 817 Chartiers Ave., Pittsburgh, Pa. 15220

[21] Appl. No.: 829,263

[22] Filed: Aug. 31, 1977

[51] Int. Cl.[2] ..... A47C 9/10

[52] U.S. Cl. ..... 182/187; 108/152

[58] Field of Search ..... 182/187; 248/393, 430, 248/429, 424; 108/152

[56] References Cited

U.S. PATENT DOCUMENTS

| | | | |
|---|---|---|---|
| 1,250,699 | 12/1917 | Sturgel | 182/187 |
| 2,868,273 | 1/1959 | Barrett | 248/424 |
| 4,009,763 | 3/1977 | Hunter | 182/187 |

*Primary Examiner*—Reinaldo P. Machado
*Attorney, Agent, or Firm*—William J. Ruano

[57] ABSTRACT

A combined adjustable seat and ladder or foot support for mounting on a pole for use by a lineman when doing work on a power line, telephone line or the like. The entire assembly is easily collapsed. The seat is supported on a carriage and is selectively moveable to different positions along a horizontal frame to selectively position the worker closer to or away from the pole. A ladder element is so connected as to enable foot support by the worker and which is also collapsible.

2 Claims, 5 Drawing Figures

IV
IV
V
V

POLE SEAT AND LADDER

This invention is an improvement over my earlier invention covered by U.S. Pat. No. 4,009,763 dated Mar. 1, 1977 and relates to an improvement comprising an adjustable seat for use on a pole.

An outstanding disadvantage of presently used lineman equipment is that it is permanently attached to the pole therefore unsightly and cannot be adjusted to accomodate workers of different height, therefore is very subject to rust from rain and snow and possible failure therefrom. Also, no foot rest or platform is provided for standing or reaching high.

An object of the present invention is to overcome the abovenamed disadvantages by providing an easily and quickly adjustable seat which may be readily and selectively positioned closer to or away from the pole, as well as providing a readily collapsible ladder or foot support element.

Other objects of the invention will become more apparent from a study of the following description taken with the accompanying drawing wherein.

Figure 1:
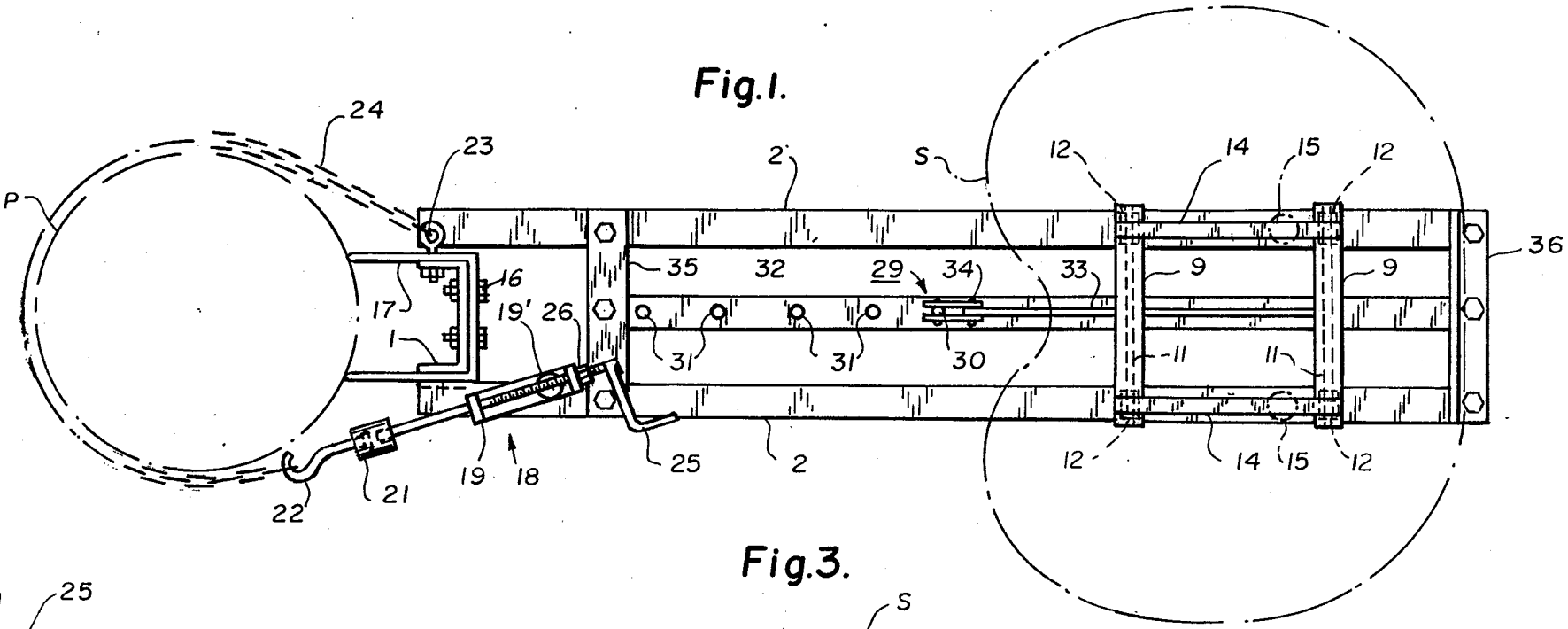
FIG. 1 is a plan view of an adjustable seat and step ladder or foot support for mounting on a pole and embodying the principles of the present invention.
Figures 2, 4, 5:
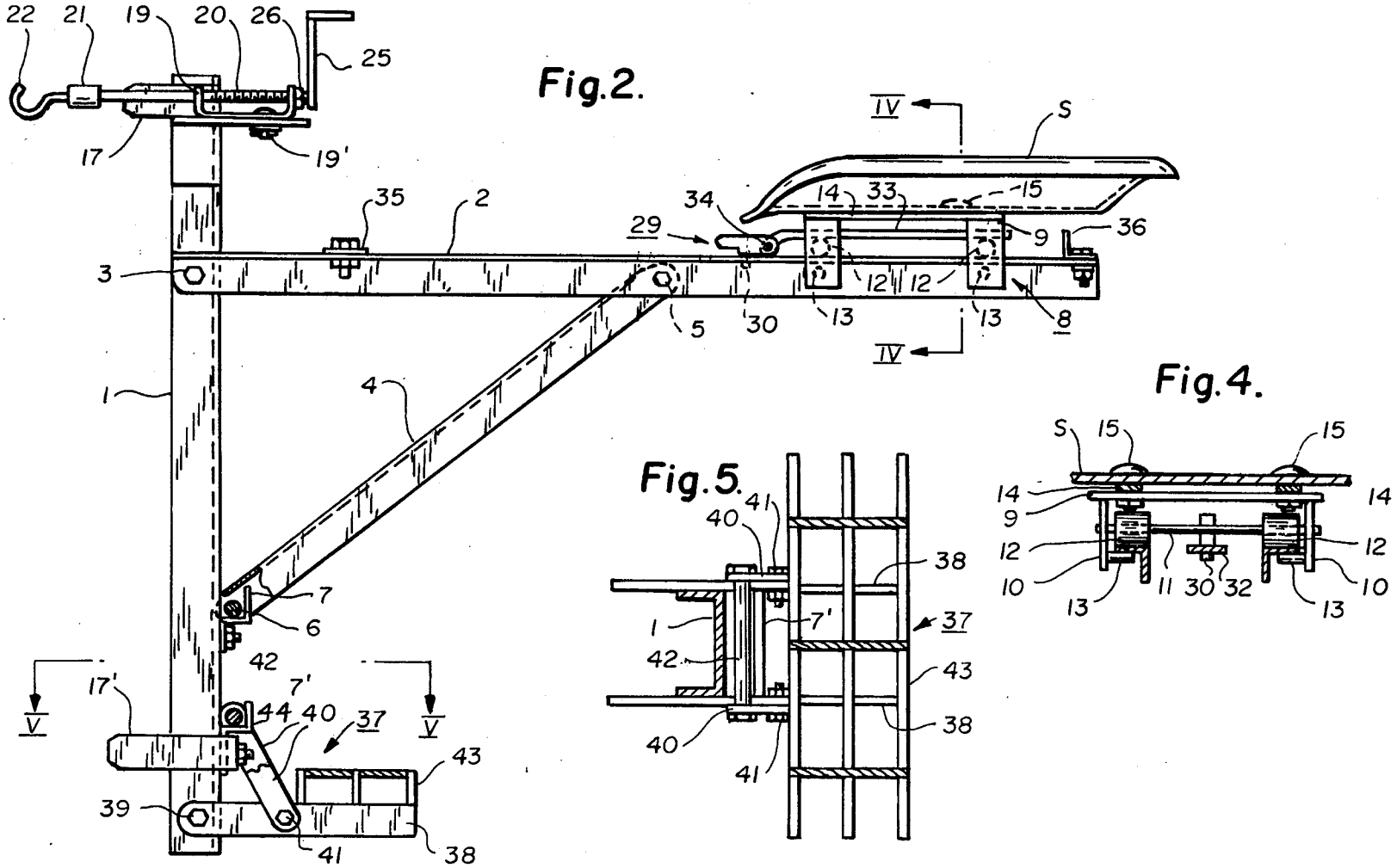
FIG. 2 is an elevational view thereof in the erected position, that is, mounted on and suspended from a pole.
FIG. 4 is a cross-sectional view taken along lines IV—IV of FIG. 2.
FIG. 5 is a fragmentary plan view of the step ladder or foot support taken along line V—V of FIG. 2.

Referring more particularly to FIGS. 1 and 2 of the drawing, numeral 1 denotes a channel shaped upright post which is positioned closely parallel to a pole P (FIG. 1) and numeral 2 denotes a horizontal frame which is pivotally connected by pivot 3 to the post 1. Numeral 4 denotes a brace consisting essentially of two parallel, angle shaped elements which are bolted together at their ends by pivot bolts 5 and 6, the latter being a removable pivot for support in a Z bar 7 or flange for removably supporting brace 4.

Numeral 8 generally denotes a seat carriage for carrying a seat S along a track provided by the upper flanges of the horizontal frame 2. Cross members 9 are provided having downwardly extending, integral legs 10 terminating in inwardly extending pins 13 so as to restrain the carriage from lateral or vertical movement. A pair of axles 11 are provided on which wheels 12 are rotatably mounted for rolling movement on the top flanges of frame 2.

Strips 14 interconnect the seat to the top of the carriage cross members 9 by means of bolts 15.

Numeral 17 and 17′ denote U-shaped brackets or cleats integrally connected by bolts 16 to the upright post 1 for penetrating the outside surface of a pole P (FIG. 1) at the selected height.

The assembly is fastened to the pole by means of an adjustable tie assembly generally denoted by numeral 18 comprising a U-shaped bracket 19 pivotally connected at 19′ to a support integrally secured to post 1. A screw threaded rod 20 is provided for selectively adjusting the peripheral length of a chain 24 hooked on one end to a hook 22 swivelly connected to a swivel or sleeve 21. The other end of the chain is connected to eye 23 secured to sprockets 17.

It will be apparent, therefore, that when crank handle 25 is turned in one direction, chain 24 is loosened and when turned in the other direction, it is tightened about the pole.

Seat S is adjustably moved by means of carriage 8 toward or away from the pole and may be held at any selected horizontal position by means of latch assembly 29 comprising a pin 30 selectively insertable in any one of a number of holes 31 (FIG. 1). The latch 32 is pivotally mounted at 34 to enable withdrawl and insertion of pin 30 into the selected holes 31. A rod 33 is rigidly connected to the axles so that by grasping the latch 32 and withdrawing it from any hole 31 and pulling it horizontally, the seat S may be selectively moved toward or away from the pole P. A cross member 35 is provided at one end of frame 2 and a stop member 36 is provided at the other end to limit the extent of longitudinal movement of the carriage.

Figure 3:
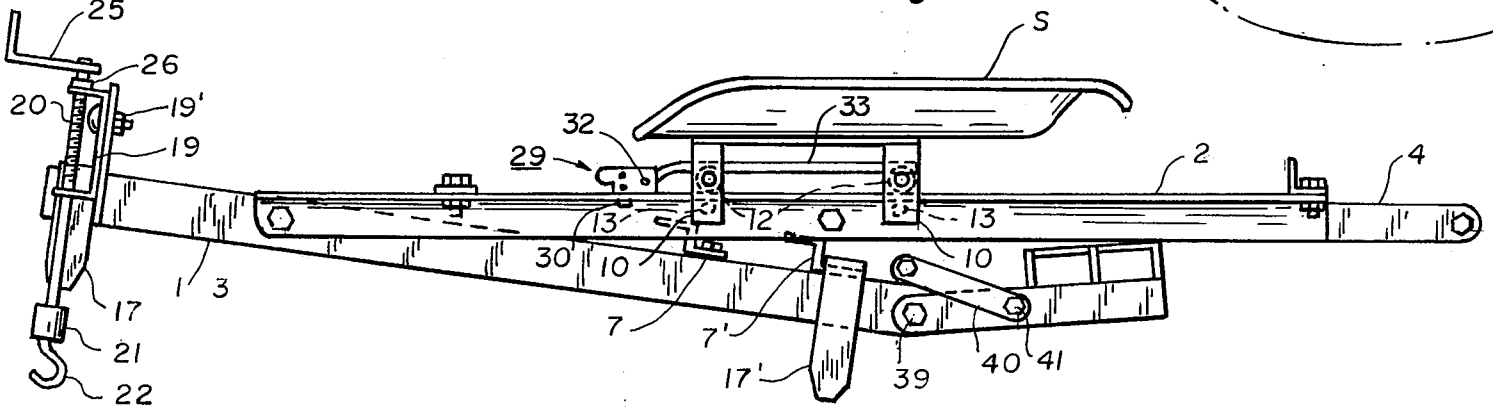
FIG. 3 is an elevational view thereof in collapsed position for transportation or storage.

A foot rest and ladder assembly 37 (FIGS. 2 & 5) is provided so that the worker can be seated and thereafter can rest his feet on a horizontal grille 3B which is pivotally connected to a pivot on post 1 or stand on the foot rest to reach a higher position on the pole as work may require. The grill assembly is selectively connected to or disconnected from a Z bar 44 integrally secured to post 1 to enable collapsing into the position shown in FIG. 3 when desirable, such as for transportation or storage.

The grid is supported by horizontally extending support rods pivotally connected to one end of a brace 40 which serves as a diagonal suspension member when the pivot rod 42 at one end is inserted in the Z bar 44. In such position it horizontally supports platform 43 and grill 38.

As additional security, an extra chain or wire rope may encircle the pole immediately beneath horizontal frame 2 to prevent accidental downward slipping of the assembly.

Thus it will be seen that I have provided a highly efficient and adjustable seat support and foot support for mounting on a pole by a lineman to provide comfort while he is working on electrical wires and the like; furthermore, I have provided a readily adjustable seat which may be selectively moved along a horizontal frame and selectively attached thereto at various positions close to or away from the pole; furthermore, I have provided a readily collapsible ladder element and foot support which can be collapsed onto the assembly when not needed; furthermore, I have provided an assembly which is so constructed as to be totally collapsible into a very compact arrangement, facilitating shipping as well as storage.

While I have illustrated and described a single specific embodiment of my invention, it will be understood that this is by way of illustration only and that various changes and modifications may be contemplated in my invention and within the scope of the following claims.

I claim:

1. A collapsible seat assembly for mounting on a pole comprising an upright post, a horizontal frame having one end pivotally connected to the post, a brace having one end pivotally connected to said horizontal frame and the other end detachably connected to said post, a seat mounted on a carriage which is movable on said horizontal frame, said carriage comprising inverted U-shaped members having depending legs forming pivotal supports for axles and inwardly extending pins at the lower extremities of said inverted U-shaped members for engagement with the undersurface of said horizontal frame to prevent lateral or upward movement of the carriage, a connecting element rigidly secured to said axles, attaching means for selectively attaching said carriage to different longitudinal positions, said attaching means comprising a latch pivotally connected to said carriage, and a plurality of holes on the top of said horizontal frame into which a pin of said latch is selectively inserted to adjustably position the seat towards or away from said pole, chain means attached to said upright posts for encircling a pole, crank means for tightening said chain means to enable suspension from said pole, and cleat means on said post for penetrating the outer surface of said pole.

2. A collapsible seat assembly as recited in claim 1 together with stop means near the outer end of said frame for limiting outer movement of said carriage thereon.

* * * * *